US007351215B1

(12) United States Patent
Roberts

(10) Patent No.: US 7,351,215 B1
(45) Date of Patent: Apr. 1, 2008

(54) DUAL-COMPARTMENT, DUAL-FUNCTION COSMETIC CONTAINER AND THERAPEUTIC DEVICE

(75) Inventor: Matthew Adam Roberts, Newbury Park, CA (US)

(73) Assignee: Illusions International, Inc., Camarillo, CA (US)

( * ) Notice: Subject to any disclaimer, the term of this patent is extended or adjusted under 35 U.S.C. 154(b) by 20 days.

(21) Appl. No.: 11/398,815

(22) Filed: Apr. 5, 2006

(51) Int. Cl.
*A61H 1/00* (2006.01)
*A45D 33/00* (2006.01)

(52) U.S. Cl. ..... 601/70; 601/46; 601/72; 132/294

(58) Field of Classification Search ..... 601/46, 601/48, 49, 56–59, 60, 65, 67, 69, 70, 72, 601/73, 79, 80–84; 600/38; 132/294, 296, 132/300, 303; 446/73
See application file for complete search history.

(56) References Cited

U.S. PATENT DOCUMENTS

| | | | | |
|---|---|---|---|---|
| 1,709,140 | A * | 4/1929 | McAtree | 132/296 |
| 5,413,551 | A * | 5/1995 | Wu | 601/46 |
| 5,704,902 | A * | 1/1998 | Vandenbelt et al. | 601/72 |
| 5,906,212 | A * | 5/1999 | Favre | 132/300 |
| 7,108,668 | B2 * | 9/2006 | Fang | 601/70 |

* cited by examiner

*Primary Examiner*—Quang D. Thanh
(74) *Attorney, Agent, or Firm*—Marcelli Law Offices, A PLC; Michael A. Marcelli

(57) ABSTRACT

The device described herein comprises a dual-compartment container for the storage of women's make-up and an electrically powered therapeutic massage unit. The unit resembles a make-up compact in size and appearance, yet contains a second, less obvious compartment housing an electrically powered, variable speed, variable intensity, vibrator which may be utilized to relieve physical or sexual tension.

5 Claims, 14 Drawing Sheets

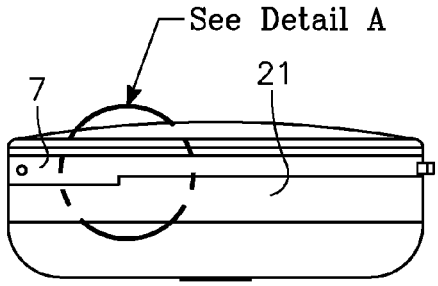
FIG. 6
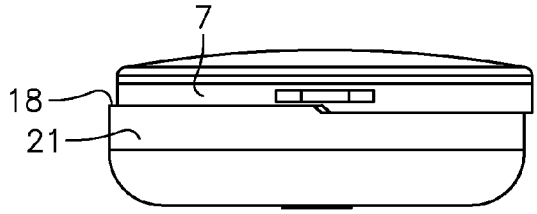
FIG. 7
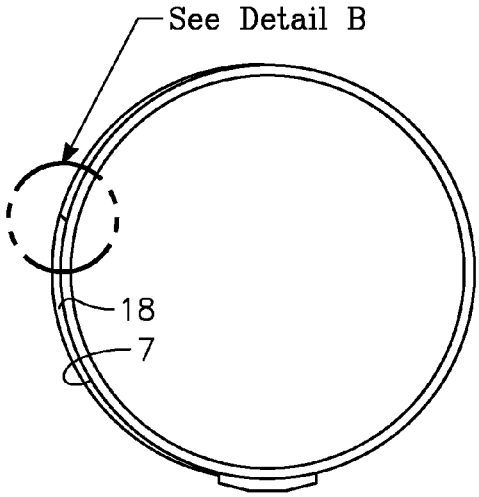
FIG. 8
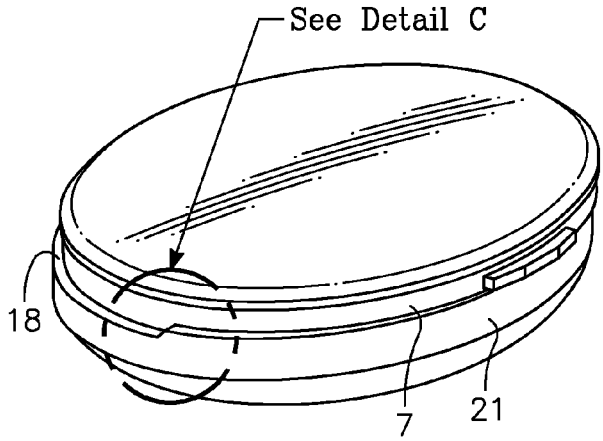
FIG. 9
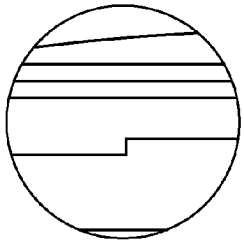
Detail A
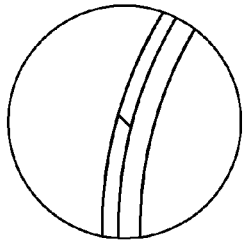
Detail B
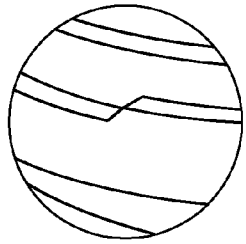
Detail C

DUAL-COMPARTMENT, DUAL-FUNCTION COSMETIC CONTAINER AND THERAPEUTIC DEVICE

STATEMENT REGARDING FEDERALLY SPONSORED RESEARCH OR DEVELOPMENT:

Not applicable.

BACKGROUND AND BRIEF SUMMARY OF THE INVENTION

Compacts for the storage and transportation of cosmetics such as powder, wet/dry foundation, rouge or blush, are well established in the art. Such compacts typically have a base member with a compartment therein for holding and storing the desired cosmetic and a cover member that is pivotally hinged to the base member of the device which allows movement of the cover member between an open and closed position. By opening and closing the cover, the user can obtain access to the cosmetics or protect the cosmetic from damage while transporting the make-up contained therein, respectively. One may typically open any woman's handbag and find one or more such compacts.

Therapeutic massage devices, commonly known as vibrators, are also well established in the art. A typical vibrator is comprised of a power source, controller, a variable speed motor, an eccentric mass attached to the spindle of the variable speed motor and a means for electrically connecting the power source to the controller and for connecting the controller to the motor. These devices, while they have multiple therapeutic uses, are generally recognizable as vibrators used for sexual stimulation. As such, the public display of such devices carries with it a degree of societal disapproval. Even the perception of public disapproval is such as to cause a stigma against public display or everyday transportation of these devices. Thus, while the therapeutic benefits of these devices cannot reasonably be disputed, the societal stigma attached to their public display renders it unlikely to find such a device in a handbag or other form of carry on luggage. While some have attempted to disguise these devices as other items, such as cellular phones or lipstick containers, the aforementioned devices continue to perform only one function and this is to act as a vibrator. As such, they unnecessarily take up additional space in a handbag.

The present invention comprises not one, but two containers: a lower, base container, that houses a power supply, controller, variable speed motor with an eccentric mass attached to said motor's spindle, i.e., the vibrator components, and an upper container containing actual, usable, cosmetic powder(s). As such, this invention addresses not only the user's privacy concerns, but also eliminates the necessity carrying a separate device thus saving valued cargo space in a handbag or carry-on luggage.

This invention has been designed, constructed and sized to resemble a typical cosmetic compact such as is used to transport and store powder, wet/dry foundation, rouge or blush. However, this invention is unique and novel in that it not only serves the aforementioned cosmetic storage and transportation functions, it also serves as a discrete means for the storage and transportation of a fully functional therapeutic massage unit, also known as a vibrating egg.

In the preferred embodiment, the upper and lower compartments share a middle cylindrical component referred to herein as the swing cover (See, FIG. 5, #7). The swing cover serves multiple functions. The top surface of the swing cover (see FIG. 10), serves as a hinged point of attachment for the cover (FIG. 5, #1) at its 6:00 position (FIG. 10, #8), a hinged point of attachment for the applicator tray (FIG. 5, #4) at its 9:00 position (FIG. 10, #10); the locus and attachment point of the latching mechanism (FIG. 5, #11) and serves as a cylindrical receptacle (FIG. 10, #9) for the cosmetic cake. When the applicator tray is folded flat such that it overlays the make-up cake (FIG. 5, #4) and the cover is closed so the rim of the cover it snaps over the top surface of the latching mechanism, the contents of the upper compartment are securely stored for transportation. (FIG. 1).

Also in the preferred embodiment, lower portion of the swing cover (FIG. 11) serves as the pivoting lid of the lower compartment. The upper and lower compartments are held together by means of a vertically protruding pivot post (13) located on the lower surface of the swing cover (FIG. 11, #13) which post mates with a post receptacle (26) in the base. The pivot post is approximately positioned between the outer radius of the lower surface of the swing cover's cylindrical receptacle at its 6:00 position (FIG. 11, #13) and the hinged point of attachment for the cover (8). The actual locations of the pivot post (13) and post receptacle (26) (hereinafter collectively referred to as the "post assembly") are not crucial, except that the radial location of the post assembly must be sufficiently distant from the vertical axis of the invention to permit the user to access all of the component features of the lower compartment (including the removable/replaceable vibrating egg, wire ribbon and retractor assembly (17) and the control panel) when the swing cover is rotated to its fully open position. FIG. 15. Furthermore, the pivot post (7) and pivot post receptacle (26) must be coaxially aligned such that the entirety of the exterior surfaces of the upper and lower compartments and concentrically aligned when the swing cover is in its fully closed position (FIG. 1), and no portion of the base cover tray (18) is visible when viewed from the top of the device looking down. FIG. 2. A relief channel is cut, from approximately 8:00 to 12:00, in the lower radial surface of the swing cover (FIG. 11, ##16A, 16B). This channel mates with a corresponding ridge located in the base, from approximately 4:00 to 12:00 on the top radial surface of the base (FIG. 14, ##24A, 24B) when the swing cover is in the fully closed position. It is important to note that the mating of these recesses and ridges prevents over-rotation of the swing cover, and permits the cover to rotate in one direction. See, FIG. 6.

To open the lower compartment in the preferred embodiment, the swing cover is rotated in a counterclockwise direction. As the top compartment pivots counterclockwise, a gap forms between the mating surfaces of the swing cover and base (FIG. 7) and the egg and cartridge holder/base cover (18) begins to become visible (FIG. 8, #18). (Note: Nothing prohibits the swing cover and base mating surfaces from being located 180 degrees opposite from those depicted in the drawings. If the device was designed in such a manner, it would function identically as to that described herein, with the exception that the swing cover would have to be rotated in the clockwise position to open the lower compartment.

As the swing plate continues to rotate counterclockwise, more elements of the lower container become visible. (FIG. 16). Please note that even with the device three-quarters open, crucial elements that identify the device as a vibrator, such as the entirety of the vibrating egg and control panel, are still shielded from view in the event that the device is inadvertently partially opened. Full access to the lower compartment may be had when the swing cover is rotated 180 degrees counterclockwise, whereby the majority of the vibrating egg and control panel are exposed. (FIG. 15).

Finally, this invention is unique and novel in that it utilizes a removable and replaceable vibrating egg, wire ribbon and retractor assembly (17). Said assembly may be removed for regular cleaning or replaced should any component part of the assembly be damaged and the unit rendered inoperable.

BRIEF DESCRIPTION OF THE SEVERAL VIEWS OF THE DRAWINGS

FIG. 6: Fully closed side view of invention. Detail A shows the mating surfaces of swing cover (7) and the base (21) are fully engaged when both compartments of the device are fully closed.

FIG. 7: A frontal view of the invention with the top compartment fully closed and the swing cover (7) rotated axially two point five degrees (2.5°) around the pivot post (13).

FIG. 8: A bird's eye view of the gap forming between the fully closed upper compartment and lower compartment of the invention as the swing cover (7) rotated axially two point five degrees (2.5°) around the pivot post (13). Detail B shows that the inner surface of the egg and cartridge holder/base cover (18) becomes visible from the top of the invention looking down as the swing cover (7) axially rotates around the pivot post (13).

FIG. 9: A tilted side view of the gap forming between the upper compartment and lower compartment of the invention as the swing cover (7) rotated axially two point five degrees (2.5°) around the pivot post (13). Detail C shows that the inner surface of the egg and cartridge holder/base cover (18) becoming visible from the side of the invention as the swing cover (7) axially rotates around the pivot post (13).

DETAILED DESCRIPTION OF THE INVENTION

The invention is generally comprised of two separate and discrete compartments: one compartment, the upper compartment, which is used for the transportation, storage and application of makeup; and a second, lower, substantially hidden compartment for the storage of a fully functional therapeutic massage unit/sexual pleasure aid.

Figure 5:
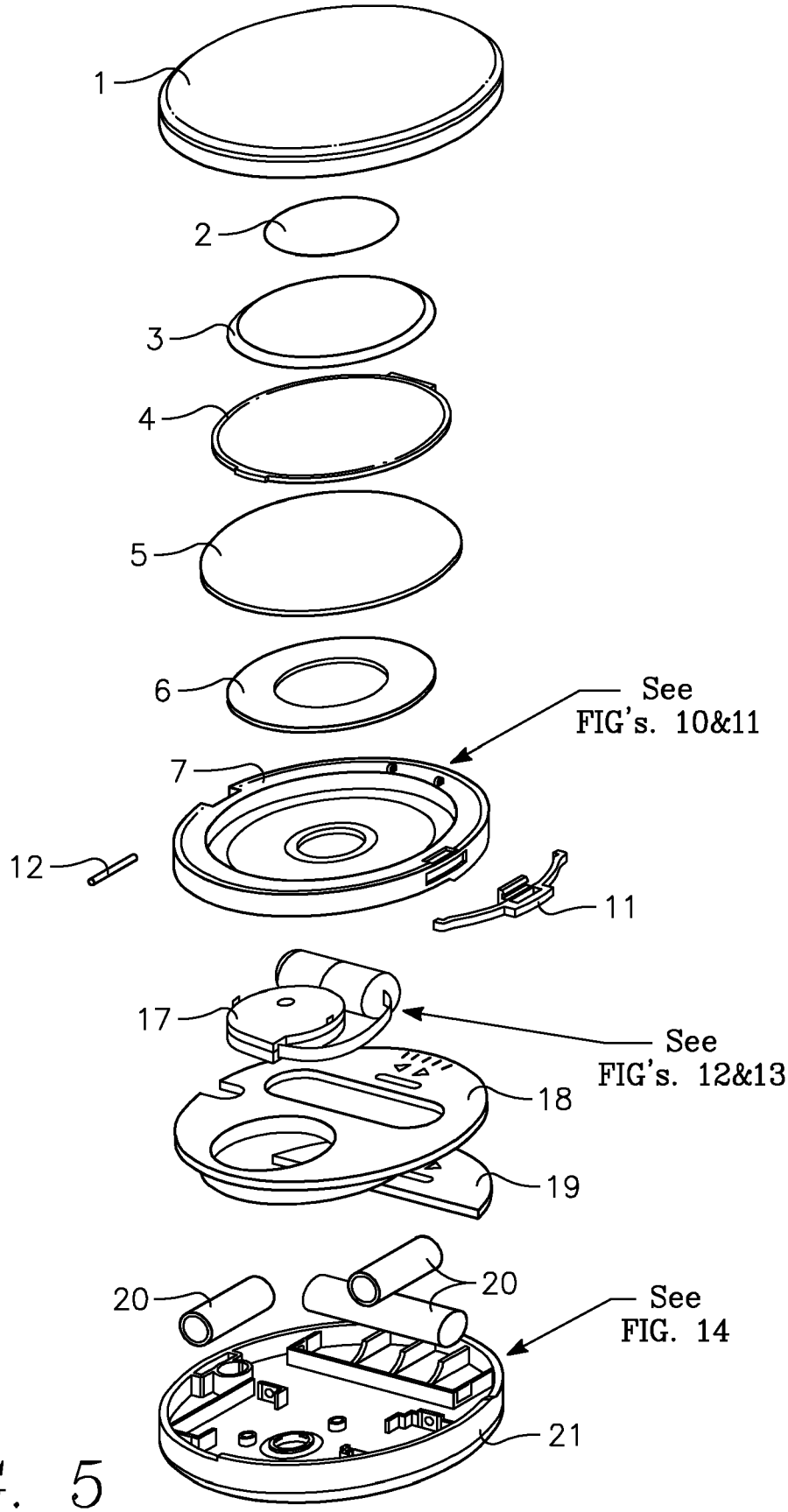
FIG. 5: Exploded view of invention showing the: cover (1); mirror (2); make-up applicator (3); applicator tray (4); makeup cake (powder/wet dry foundation) (5); magnet (6); swing cover (7); release button/latching mechanism (11); hinge pin (12); removable/replaceable vibrating egg, wire ribbon and retractor assembly (17); egg and cartridge holder/base cover (18); device control panel/circuit board (19); rechargeable batteries (20); and base (21).
Figure 10:
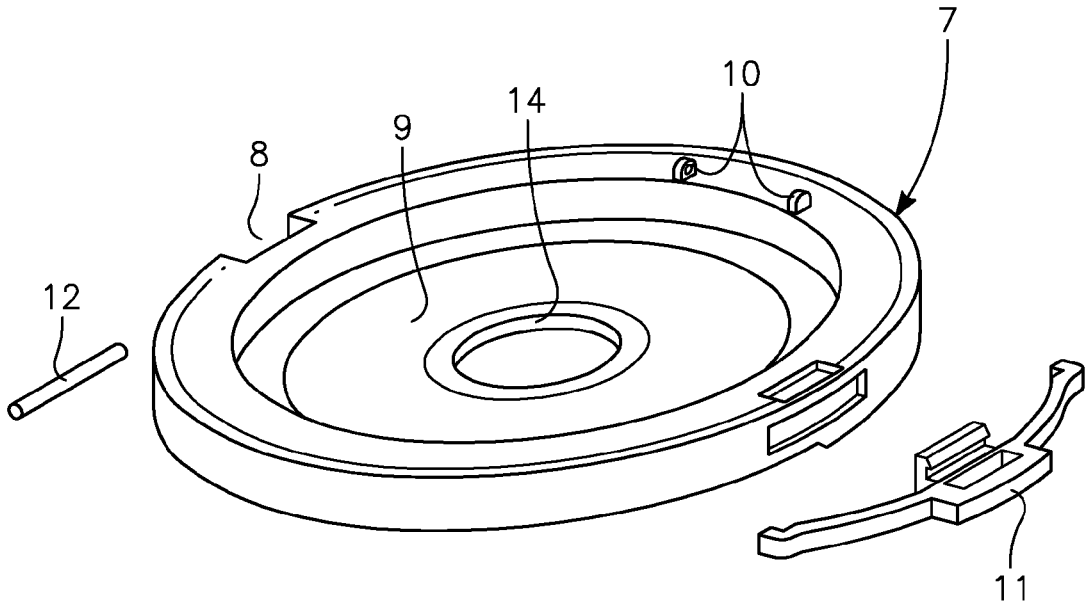
FIG. 10: Detailed tilted view of upper surface of swing cover (7) showing the hinge pin (12) and cover hinge (8); magnet mounting surface and make-up receptacle (9); applicator tray hinges (10); and latching mechanism (11).

The upper compartment is comprised of a cover (1) that is hingedly attached to the swing cover (7). The swing cover serves multiple functions. In the preferred embodiment, the top surface of the swing cover (See FIG. 10) is a wide rimmed cylinder. The swing cover serves as a hinged attachment point for the cover (FIG. 5, #1) at the swing cover's 6:00 position (FIG. 10, #8), a hinged point of attachment for the applicator tray (FIG. 5, #4) at 9:00 on the upper surface of its wide rim (FIG. 10, #10); and the locus and attachment point of the latching mechanism (FIG. 5, #11) at 12:00. The outer radial edge of the swing cover is outwardly beveled. Said outwardly beveled surface mates with the inwardly beveled radial surface on the cover when the upper compartment is in its fully closed position. The latching mechanism (11) is comprised of front, back top and bottom surfaces. The front surface of the latching comprises a radiused button that, when installed in the swing cover, protrudes from the swing cover through a slot in the middle of the face of the swing cover, at the swing cover's 12:00 position. The top surface of the latching mechanism is comprised of an inwardly beveled latch, which inwardly beveled latch is either integrally molded to or mechanically connected to the radiused button described above. Said inwardly beveled latch protrudes through a hole or slot in the upper surface of the swing cover, at said swing cover's 12:00 position. The final component of the swing cover latching mechanism is a leaf spring. The leaf spring comprises the rear surface of the latching mechanism. The spring is either integrally molded to or mechanically attached to the rear surface of the radius button and arranged so that the leaves of the spring extend radially from said radiused button equidistantly. The ends of the leaves are either integrally molded into, or bent to form hooks on said ends. Said hooks are attached to posts equidistantly mounted on the bottom surface of the swing cover. The swing cover also serves cylindrical receptacle (FIG. 10, #9) for the cosmetic cake (5).

Figure 11:
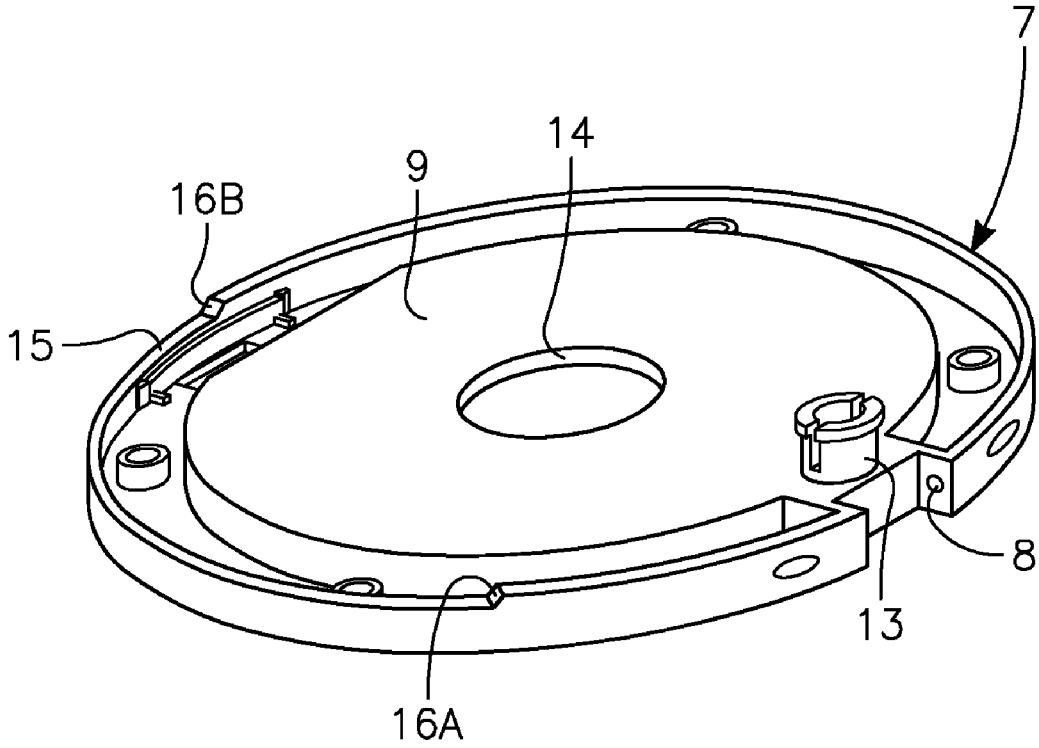
FIG. 11: Detailed tilted view of the lower surface of the swing cover (7) showing the pivot post (13) mating surfaces (16A) and (16B); lower surface of the magnet mounting surface and make-up receptacle (9); and hole in the bottom of the make-up receptacle (14) that allows the user to apply pressure to the make-up cake (4) to remove it from the device.

Cosmetic cakes are comprised of a steel or iron powder holder and the cosmetic powder cake. To help retain the cosmetic cake within the swing cover's cylindrical receptacle during transportation and use, a magnet (6) is adhesively attached to the top face of the swing cover's cylindrical receptacle and/or press fit into a housing that has been molded or machined into said top face. The cake's steel or iron powder holder sets directly on top of the magnet in when the invention is in use. When the powder in the cake is completely exhausted, the user may disengage the cake holder from the magnet by pushing on the bottom of the powder holder through a hole, centrally located, in the bottom of the swing cover (FIG. 11, #14). Please note that the use of cosmetic cakes having an iron or steel or otherwise magnetically attractive holder is not crucial to the invention, but is preferred. Cosmetic cakes having non-magnetic holders could be utilized in the invention by adhesively affixing said cakes to the magnet, with a substance such as tape or glue.

To assist in protecting the cake from mechanical damage or drying out due to contact with the applicator pad (3) an applicator tray (4) is hingedly attached to the upper rim of the swing cover at the swing cover's 9:00 position (10). Said hinged attachment allows the applicator tray to pivot about the hinge's axis in a 180 degree arc. When pivoted counterclockwise, the rotational axis of the applicator tray terminates at the point where the applicator tray fully covers the cosmetic cake contained within in the swing cover's cylindrical receptacle (the "closed position"). The applicator pad (3) may now be stored on top of the applicator tray (4) without concern that such storage will dry out or corrupt the cosmetic cake. Contrarily, when the applicator is pivoted clockwise about its hinged axis, the rotational axis of the applicator tray terminates at the point where the cosmetic cake contained within in the swing cover's cylindrical receptacle is fully accessible (the "open position").

A mirror (2) is adhesively centrally attached to the inner surface of the cover (1) and/or press fit into a housing that has been molded or machined into said inner surface which purpose is to retain said mirror. In one embodiment of this invention, a light ring comprising six to eight flat light emitting diodes ("LEDs"), encircle said mirror (2) and are either adhesively or mechanically attached to the inner surface of the top cover (1). These LED's provide illumination that enables the user to apply makeup or otherwise operate the device, in unlit or dimly lit areas. Electrical power for these LEDs is supplied via electrical wiring that runs from the control panel (19) in the lower compartment through a small void in base cover (18) at the location of the cover hinge (8) through the hinge to the cover where it attaches to the LED light ring. In an embodiment of this invention, electrical power to the LED's is supplied via electrical wiring that runs from the control panel (19) in the lower compartment to the input of a pressure switch. The output of the pressure switch is wired to the LEDs, such that power is supplied to the LEDs from the control panel (19) when the cover (1) is pivoted from its closed to its open position.

Figure 1:
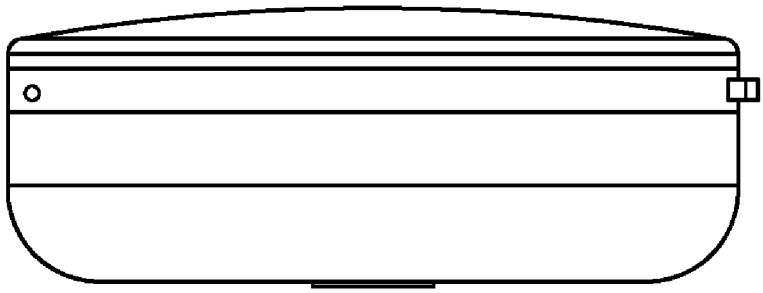
FIG. 1: Side overall view of invention.

When the applicator tray is folded flat such that it overlays the make-up cake (FIG. 5, #4) and the cover is closed so the rim of the cover it snaps over the outwardly beveled top surface of the top of the latching mechanism securely protecting the contents of the upper compartment for transportation. (FIG. 1).

In order to access and utilize the cosmetic cake contained in the upper compartment, the user depresses the cover release button, which compresses the attached leaf spring and disengages the cover latch from the recess in the cover, thereby allowing the cover to pivot about its hinge. The cover must be pivoted about its 6:00 hinge (8) to an angle sufficient to allow removal of the applicator pad and to allow the applicator tray (4) to be pivoted from its closed position to its open position. Once the applicator tray is placed in the open position, the user may access the makeup cake and use the applicator to apply the makeup to her body.

Once the user has completed application of makeup to her body, the applicator tray is pivoted from its open position to its closed position. The applicator pad is placed on top of the applicator tray and the cover is pivoted until the cover latch located at 12:00 on the top surface of the swing cover slides over the inwardly beveled edge of the cover and snaps into the recess located just above the beveled edge of the cover at the 12:00 position on the cover.

Figure 2:
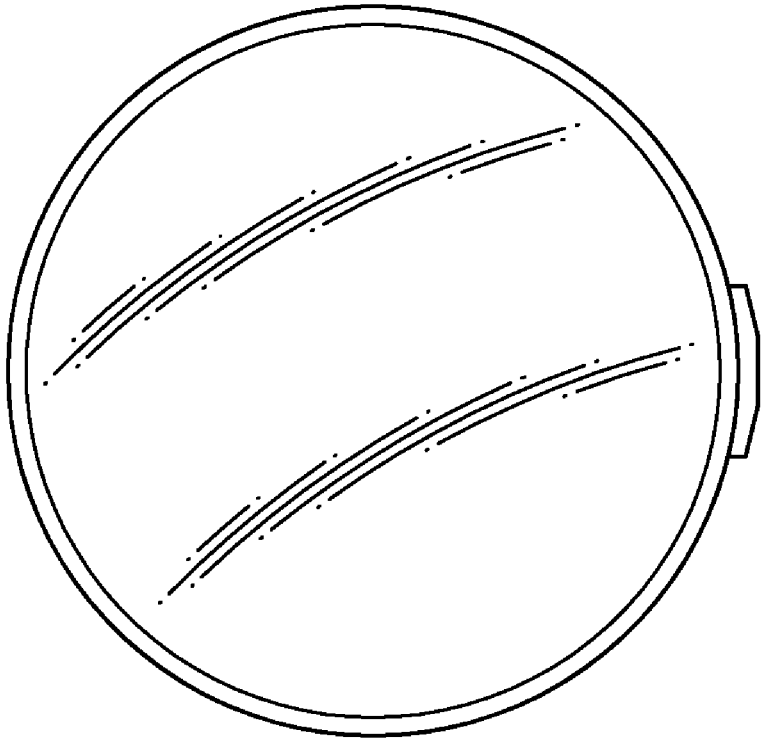
FIG. 2: Top overall view of invention.
Figure 3:
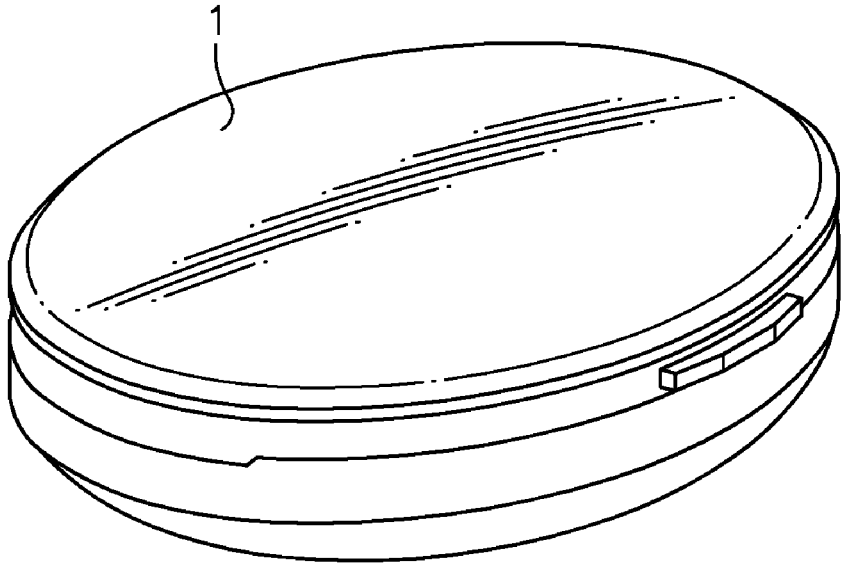
FIG. 3: Fully Closed Tilted Top view emphasizing cover (1).
Figure 4:
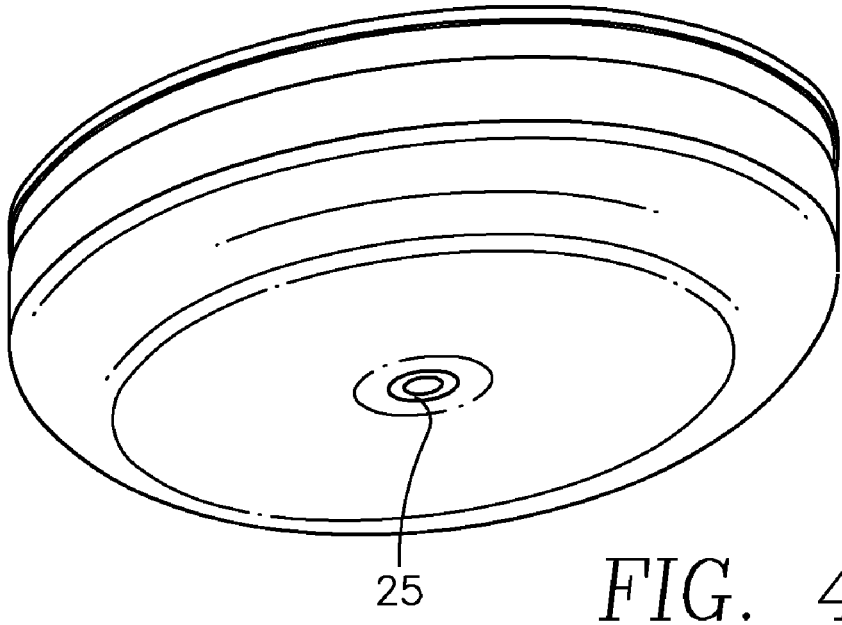
FIG. 4: Fully Closed Tilted Bottom view emphasizing charging contacts (25).
Figure 15:
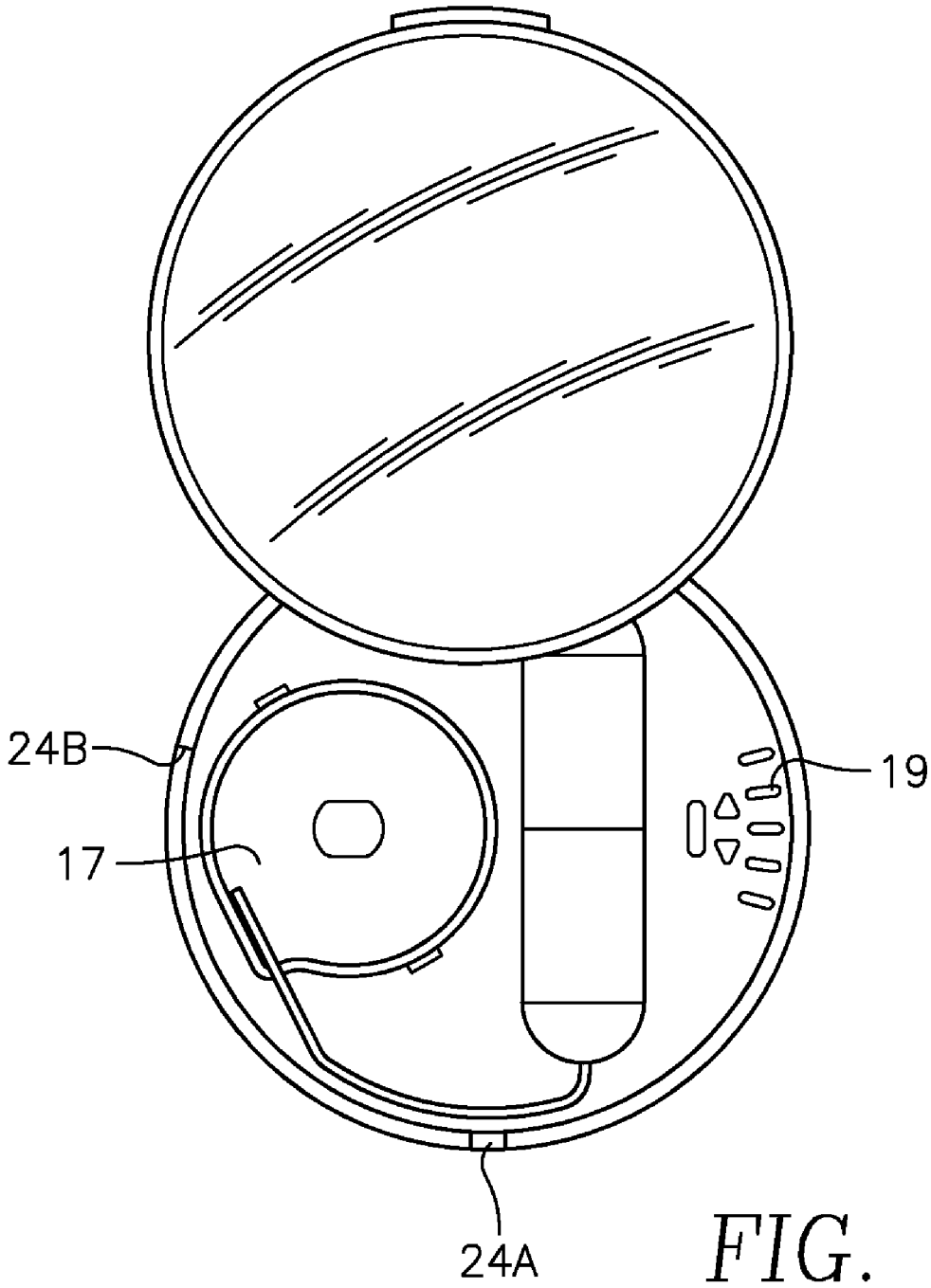
FIG. 15: A bird's eye view of the device and the swing cover rotated 180 degrees axially about the pivot post to allow full access to the control panel (19) and removable/replaceable vibrating egg, wire ribbon and retractor assembly (17).
Figure 16:
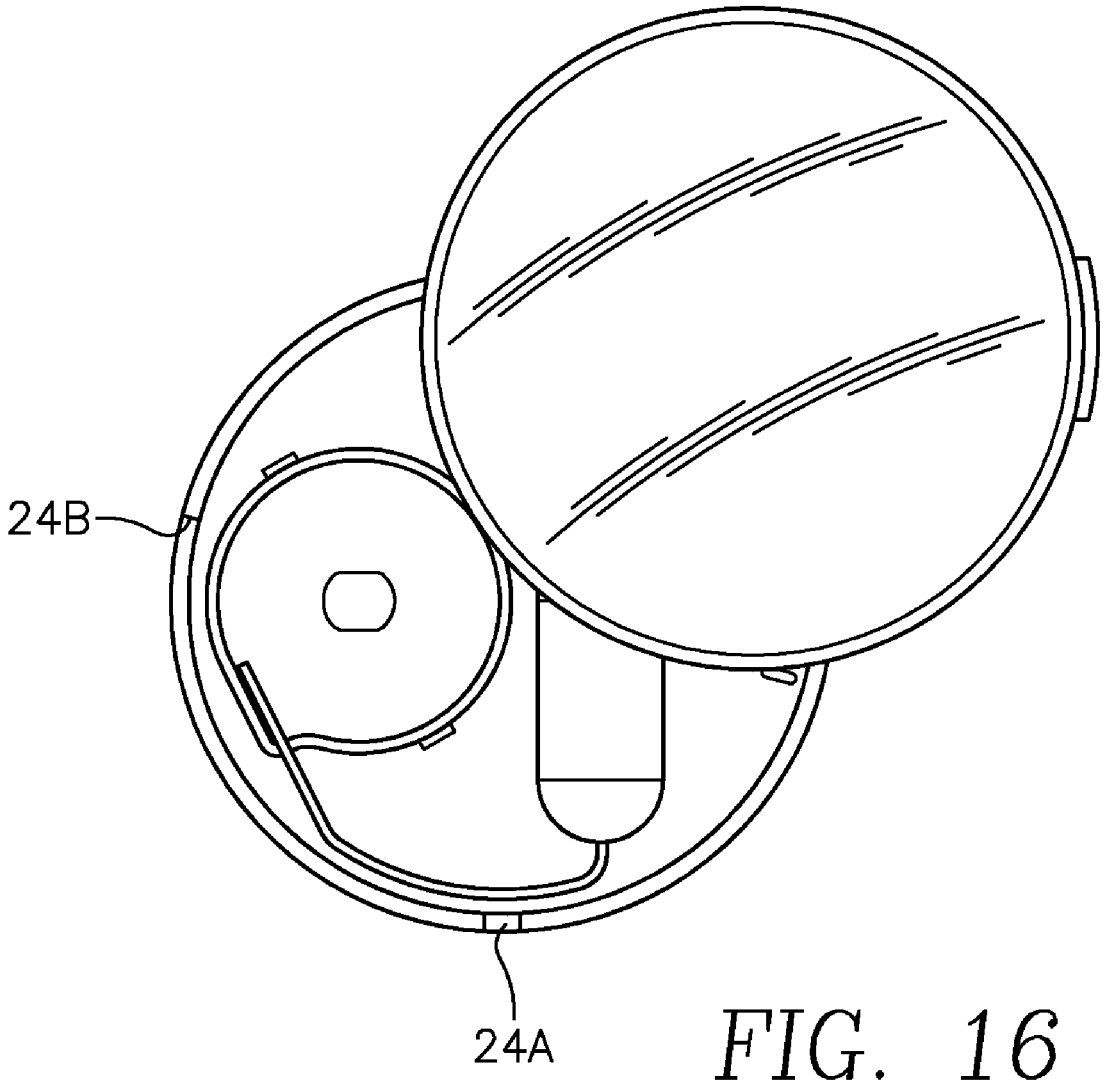
FIG. 16: A bird's eye view of the device with the swing cover rotated axially 90 degrees about the pivot post. Control panel (19) is only partially visible in this view and egg partially contained to prevent inadvertent release from the container and to protect the user's privacy.

The upper and lower compartments are held together by means of a vertically protruding pivot post (13) located on the lower surface of the swing cover (FIG. 11, #13) which post mates with a post receptacle (26) in the base. The pivot post is approximately positioned between the outer radius of the lower surface of the swing cover's cylindrical receptacle at its 6:00 position (FIG. 11, #13) and the hinged point of attachment for the cover (8). The actual locations of the pivot post (13) and post receptacle (26) (hereinafter collectively referred to as the "post assembly") are not crucial, except that the radial location of the post assembly must be sufficiently distant from the vertical axis of the invention to permit the user to access all of the component features of the lower compartment (including the removable/replaceable vibrating egg, wire ribbon and retractor assembly (17) and the control panel) when the swing cover is rotated to its fully open position. FIG. 15. Furthermore, the pivot post (7) and pivot post receptacle (26) must be coaxially aligned such that the entirety of the exterior surfaces of the upper and lower compartments are concentrically aligned when the swing cover is in its fully closed position (FIG. 1), and no portion of the base cover tray (18) is visible when viewed from the top of the device looking down. FIG. 2.

The exterior diameter of the swing cover pivot post (13) and interior diameter of the post receptacle (26) are sized to achieve an interference fit. Said interference fit is utilized to achieve minimal horizontal wobble of the swing cover as it is axially rotated around the pivot post. To assure that the pivot post and post receptacle are securely attached, the end of the pivot post most distant from the bottom of the base of the swing cover assembly is fitted with an oversized circumferential tongue that snaps into a groove located near the bottom of the radial surface of the post receptacle. An alternative method of securely attaching the base and swing cover would be to drill and tap the center of the pivot post and drill a hole through the center of the pivot post receptacle extending to the bottom exterior of the base, and attaching the base to the pivot post with a screw.

Figure 14:
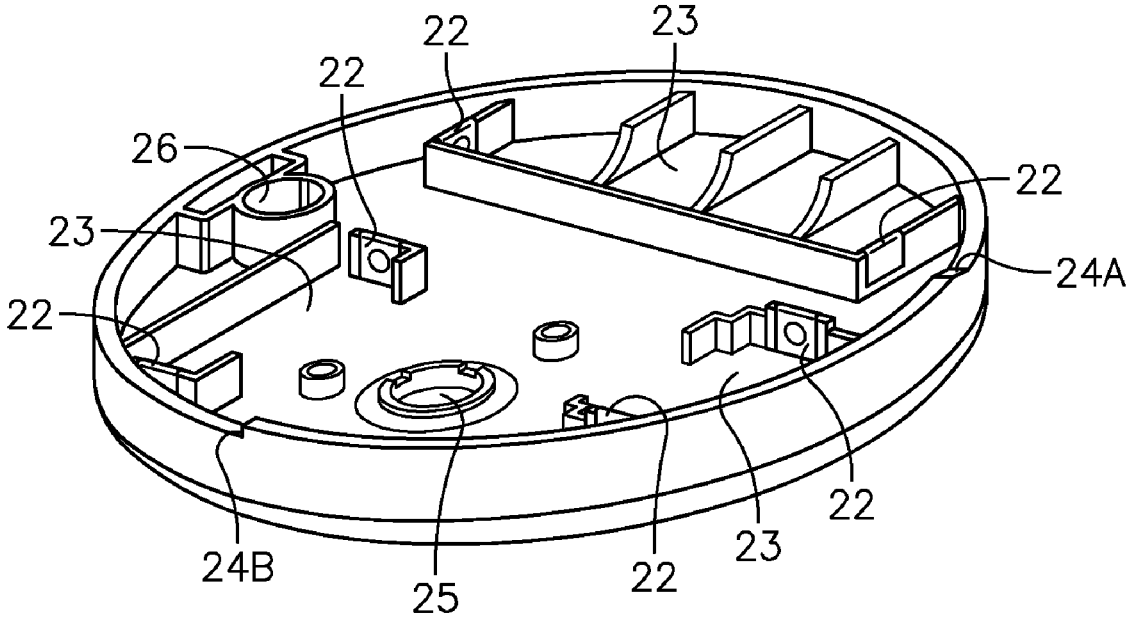
FIG. 14: Detailed tilted view of the base (21) showing three pairs of battery terminals (+/−) (22); three battery housings (23); the base mating surfaces (24A) and (24B) that mate with surfaces (16A) and (16B), respectively, of the swing cover (7) when the swing cover is closed to assure axial alignment of the upper and lower compartments when the device is completely closed. Also shown are the recharging receptacle (25) and the pivot post receptacle (26) that contains the pivot post (13) and permits the two halves of the device to rotate axially.

A relief channel is cut, from approximately 8:00 to 12:00, in the lower radial surface of the swing cover (FIG. 11, ##16A, 16B). This channel mates with a corresponding ridge located in the base, from approximately 4:00 to 12:00 on the top radial surface of the base (FIG. 14, ##24A, 24B) when the swing cover is in the fully closed position. It is important to note that the mating of these recesses and ridges prevents over-rotation of the swing cover, and permits the cover to rotate in one direction only. See FIG. 6. In one embodiment of this device, magnets are installed at locations 16A and 16B, these magnets mate to magnetically susceptible materials, such as a steel posts, or oppositely polarized magnets, located at mating points 24A and 24B on the base, respectively. The purpose of these magnets is to hold the mating sections together and prevent accidental opening of the swing cover.

The lower compartment houses the component parts necessary to operate the invention's therapeutic massage unit as well as the message unit itself. These parts include: the base (FIG. 14); a power source, either rechargeable batteries (20) and/or power supplied via an external electrical connection (25); a controller/circuit board (19); a retractable cord cartridge and cord with attached vibrating egg mechanism (17).

Figure 12A:
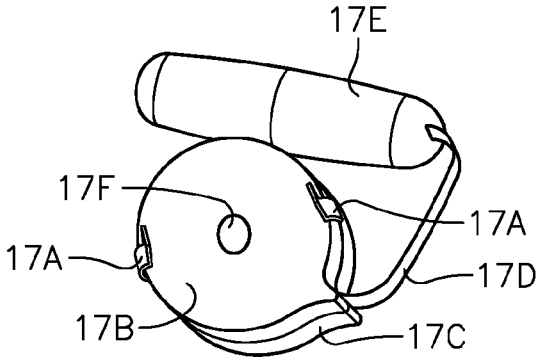
FIG. 12A: View of removable/replaceable vibrating egg, wire ribbon and retractor assembly (17), showing: retaining tabs (17A) that affix the retractor to the egg and cartridge holder/base cover (18); an external view of the upper and lower halves of the cord retractor housing (17B) and (17C), respectively; the retractable ribbon cord (17D); the vibrating egg assembly and, the clutch disengagement/cord rewind button (17F).
Figure 12B:
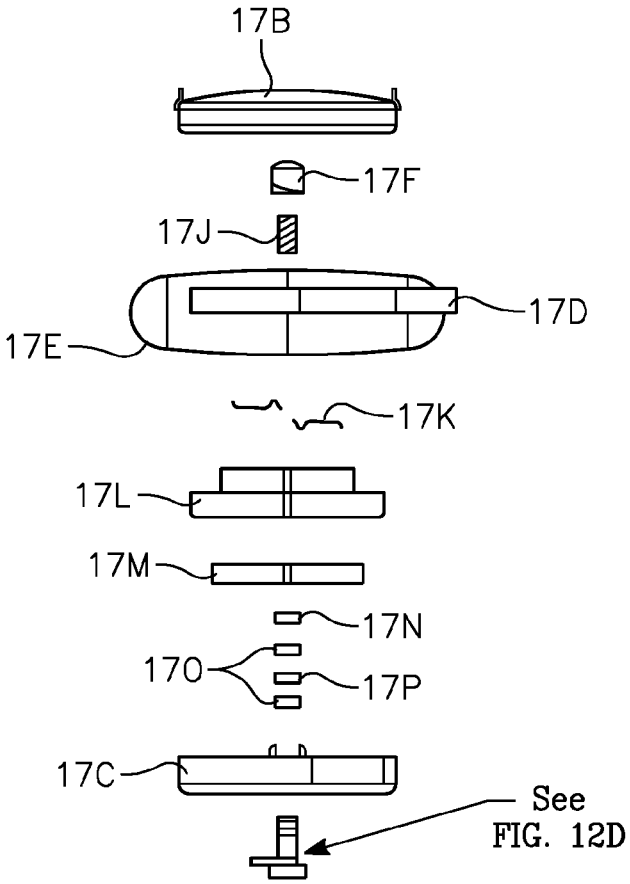
FIG. 12B: Exploded side view of the removable/replaceable vibrating egg, wire ribbon and retractor assembly (17) emphasizing: the retractor cover (17B); clutch release button (17F); release button spring (17J); vibrating egg assembly (17E); ribbon cable (17D); contact brushes (17K); ribbon cable reel (17L); coil spring (17M); contact retainer (17N); contacts (17O); insulation ring (17P); base (17C) and contact base sub-assembly (FIG. 12D).
Figure 12E:
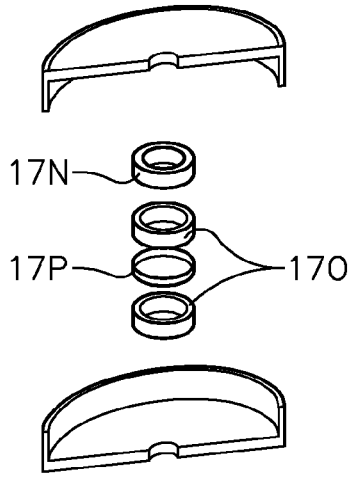
FIG. 12E: Exploded view of contact retainer (17N), contacts (17O) and insulating ring (17P).
Figure 12D:
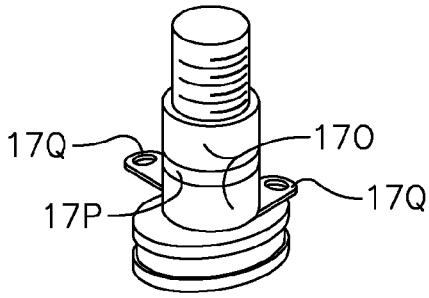
FIG. 12D: Exploded view of contact subassembly depicting: contacts (17O); insulation ring (17P); external electrical leads (17Q), and, opposing blades (17R).
Figure 12C:
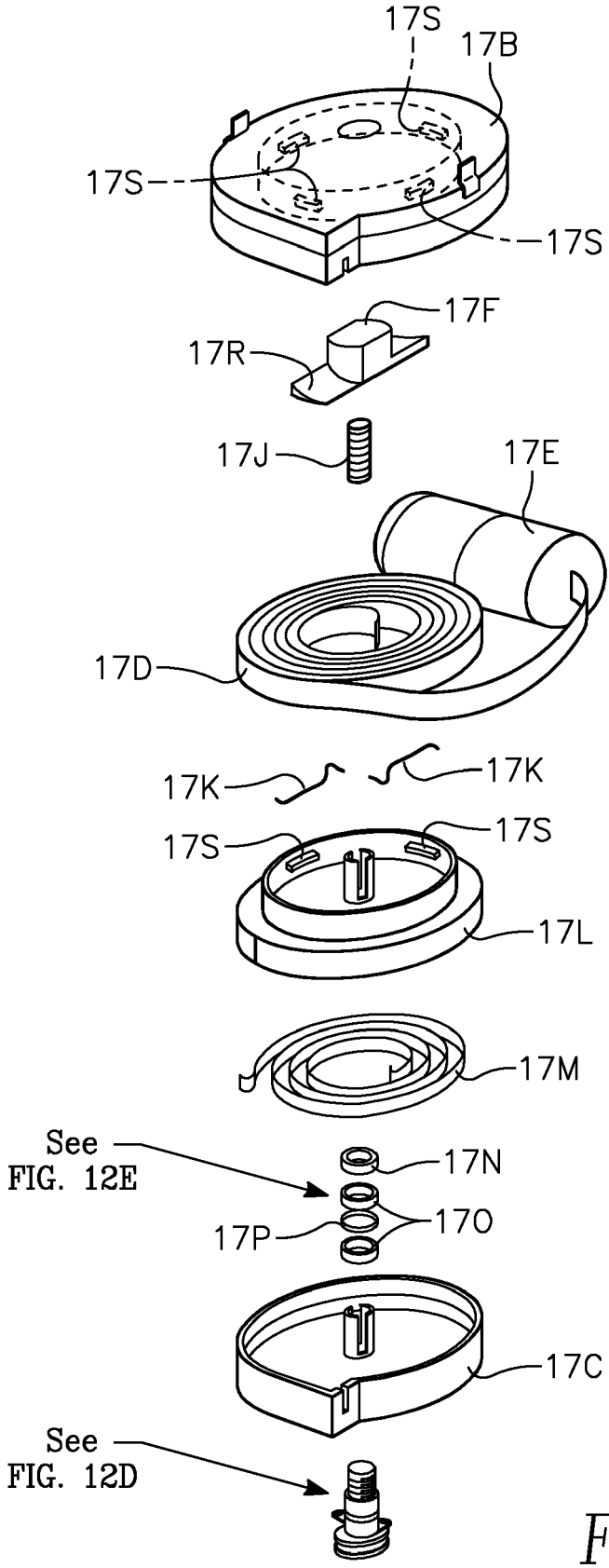
FIG. 12C: Tilted view of the removable/replaceable vibrating egg, wire ribbon and retractor assembly (17) depicting the retractor cover (17B) (Note: The dashed lines indicate the spatial location of the ribbon cable reel (17L) and the reel's interior protrusions/stops (17S) within the housing); clutch release button (17F); opposing blades (17R); release button spring (17J); vibrating egg assembly (17E); ribbon cable (17D); contact brushes (17K); ribbon cable reel (17L); coil spring (17M); contact retainer (17N); contacts (17O); insulation ring (17P); base (17C) and contact base sub-assembly (FIG. 12D).
Figure 13A:
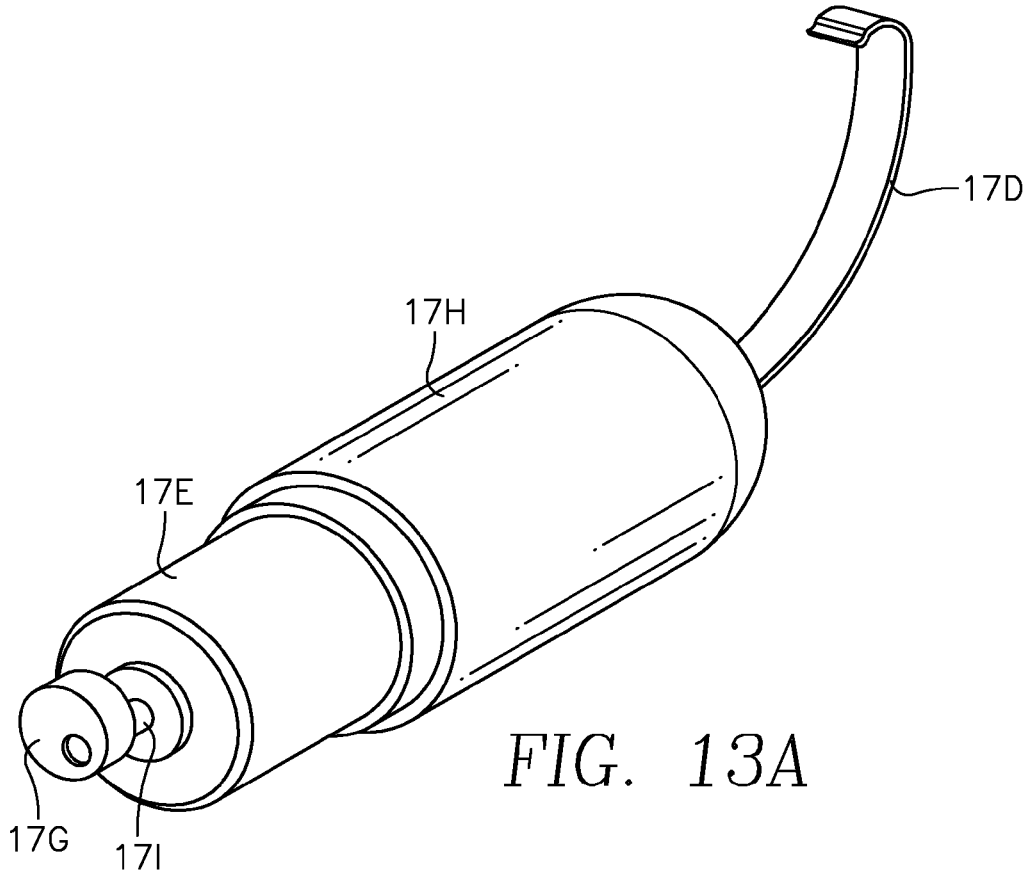
FIGS. 13A and 13B: Diagonal (FIG. 13A) and side (FIG. 13B) cut away views of the vibrating egg assembly portion of assembly (17) depicting: the rear portion of the plastic "egg" assembly (17H) that houses the variable speed motor (17E) having an attached motor spindle shaft (17I) and eccentric weight mounted on the spindle shaft (17G) and provides an inlet for the ribbon cord (17D).
Figure 13B:
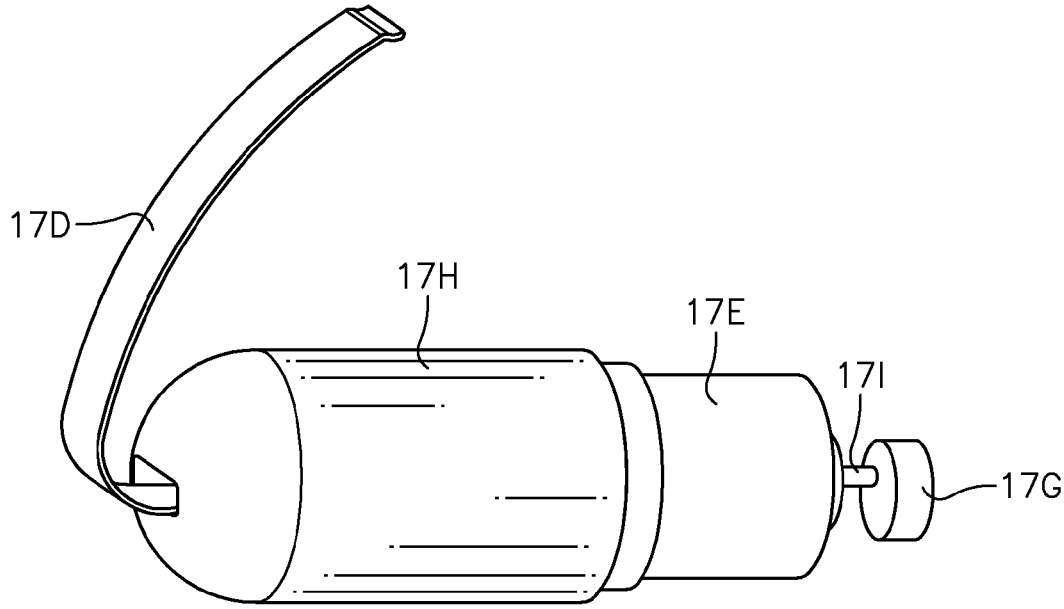

In the preferred embodiment, a rechargeable battery or batteries are housed in a battery compartment comprising a battery housing (23) with two terminals (24), one positive and one negative per housing. Terminals are electrically connected, via wires, to the both recharging receptacle and to the invention's controller (19). The controller is electrically attached, via wires or other electrically conductive means to the terminals (17Q) attached to the contact subassembly of the cord retracting mechanism. (FIG. 12D). Said retractor mechanism is removably attached to the base plate by two opposing, compressible latches (17A) attached to the upper surface of the retractor cover (17B). As will be described in more detail hereto, the terminals (17Q) conduct electrical current thru the contact subassembly to the ribbon cable (17D) and through the ribbon the variable speed motor (17E) encased in the egg shaped housing (17H). The motor's spindle shaft (17I) is fitted with an eccentrically mounted weight (17G). When the controller is actuated and electricity is supplied to the motor, the motor's spindle shaft begins to rotate and the eccentric weight located thereon causes the egg to vibrate. The controller acts as a switch to turn the power to the motor on and off. It is well established in the art that the controller can be chosen to vary the voltage and waveform of the electricity supplied to the motor such that the motor produces different vibration patterns and intensities. A particular vibrational pattern and intensity may be chosen for a particular therapeutic purpose, for example a deep muscle massage to a gentle sexual stimulus. The base cover (18) is adhesively attached to the top of the base. The base cover serves as an attachment point for both the controller and the wire ribbon retractor assembly. In one embodiment, copper wire or ribbon is molded into the base so that electricity is conducted between the control panel and the wire ribbon retractor assembly. The base also houses the vibrating egg assembly.

The retractor assembly is comprised of a cover housing (17B), a clutch release button (17F), a release button spring (17J), two contact brushes (17K), a ribbon cable reel (17L), a coil spring (17N), a contact retainer (17N), two contacts (17O), an insulating ring (17P) a base and a subassembly further comprising a central post and two electrical leads (17Q).

The clutch release button (17F) is further comprised of a hollow keyed post, approximately half of which is flat surface and the remainder of which is radiused and having a top and bottom. The top of the post extends though a keyed hole in the top cover (which keyed hole prevents the clutch release button from rotating under load) and provides a means for disengaging the obstructive clutch mechanism described herein. The bottom of the hollow keyed post is further comprised of opposing blades (17R). Said opposing blades are mounted perpendicularly to the center axis of the hollow keyed post. Said opposing blades are constructed such that leading edges of said opposing blades are narrower than the following edges of the opposing blades. Finally, the hollow keyed post retains a spring within its hollow cylindrical center cavity. The top surface of the spring bears against the bottom of clutch release and the bottom surface bears against the non-conducting retainer when the unit is fully assembled, by arranging the component parts as set forth herein and adhesively attaching the cover housing and the base.

The ribbon cable reel is comprised of an upper and lower housing. The upper housing further comprising a split cylinder, a hollow center post at the center of said split cylinder, said hollow center post being the point of attachment for two brushes, an upper brush and a lower brush, which brushes extend from the interior of the hollow center post to the exterior of the hollow center post and one to four interior protrusions or stops (17S), protruding from the upper interior surface of the split cylinder towards the center of the split cylinder. Said split in the cylinder provides an entry point for ribbon cable, which ribbon cable houses two wires. The two wires are electrically attached to the upper and lower brushes.

The lower housing comprises a receptacle for the coil spring. The ends of the coil spring are bent to form two hooks, an outer hook and an inner hook. The inner hook attaches to a post protruding axially from the bottom cover (17C) adjacent to the hole in the base assembly that accepts the contact sub-assembly (FIG. 12D). The outer hook attaches to slot in the outer surface of the lower housing of the reel assembly. The subassembly is comprised of two electrical leads, an upper and a lower lead, (17Q), one for each polarity (+ and −) that are removably wired to the controller, and two metal contact surfaces, an upper and lower contact (17O). Said upper and lower contact surfaces are electrically isolated from each other by an insulation ring (17P) and are held together by a contact non-conducting retainer (17N) at the terminus of the subassembly. The lower lead supplies electrical current to the upper contact and the upper lead supplies current to the lower contact.

The contact subassembly is contained within the hollow center post on said reel assembly, such that the upper brush touches the upper contact and the lower brush touches the lower contact. This arrangement allows electrical current to flow from the controller, through the retractor's sub-assembly, into the cable and to the vibrating egg assembly irrespective of the rotational orientation of the cable reel.

As described herein, it is unnecessary to depress the clutch release button to unwind the ribbon cable, for as cable is pulled from the assembly, the thinner leading edge of the opposing blades engage the stops in the reel's upper housing at an angle sufficient to place enough pressure on the spring to permit the blade to slip under the stop. Once the entire blade clears the stop, the spring raises the clutch release button to its top position. If tension of the ribbon cable is now removed, the cable will not retract because the thicker, trailing edge of the opposing blades will not permit the blade to slip under the stop. Retraction of the ribbon cable is accomplished by depressing the clutch release button, thereby disengaging the trailing edge of the blade from the stop, and permitting the coil spring to rewind the ribbon cable.

Figure 17:
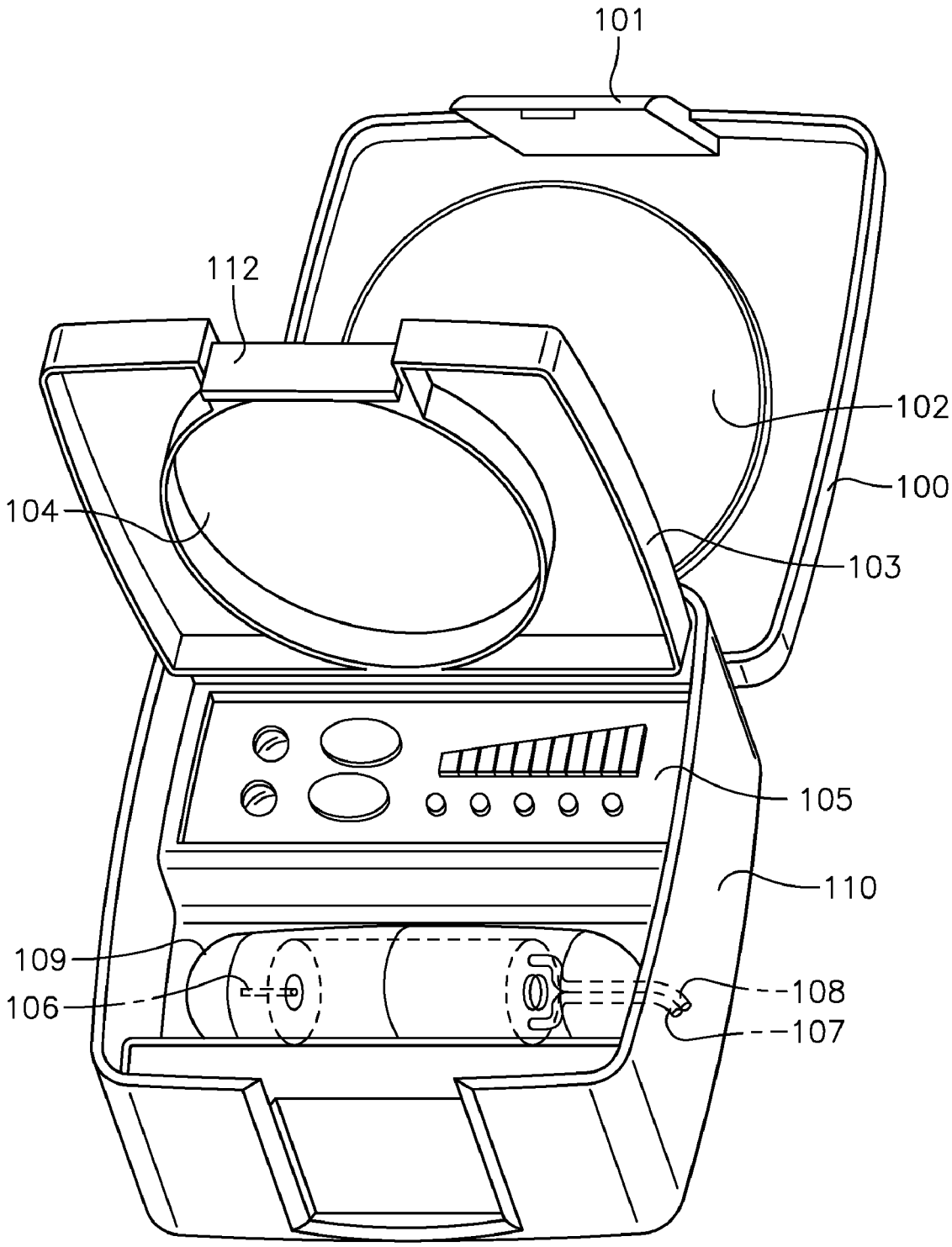
FIG. 17: Fully open view of second embodiment of the invention depicting a top cover (100); pivoting top cover latch (101); mirror (102); hingedly attached swing cover (103); bottom surface of the makeup receptacle (104); control panel (105); motor and spindle assembly of transparent vibrating egg assembly (eccentric weight not shown, but present in embodiment) (106); housing (109); and wire leads (107, 108) which connect to a hidden, rechargeable power supply in the base (110).

An alternative embodiment of the invention is illustrated in FIGS. 17 and 18. In this embodiment, the cover (100) and swing cover (103) are each hingedly attached to the base (110) of the device. A centrally located rectangular post extends from the rear bottom of the cover, such that the rectangular post forms a 90 degree angle with the bottom of the cover. The length of said rectangular post being one-half the width of the base. Said post serves as the hinged connection point between cover and the base. Said hinged connection point being located central to the base's sides and approximately equidistant from the base's top and bottom surfaces. The rear outer surface of the base has a central recess extending from the top edge of the base towards the bottom of the base. The length and width of this central recess are equal to the length of the rectangular post, such that the post is completely contained within the recess when the cover is closed. A large latch is centrally mounted on the front of the cover, opposite the hinges.

Figure 18B:
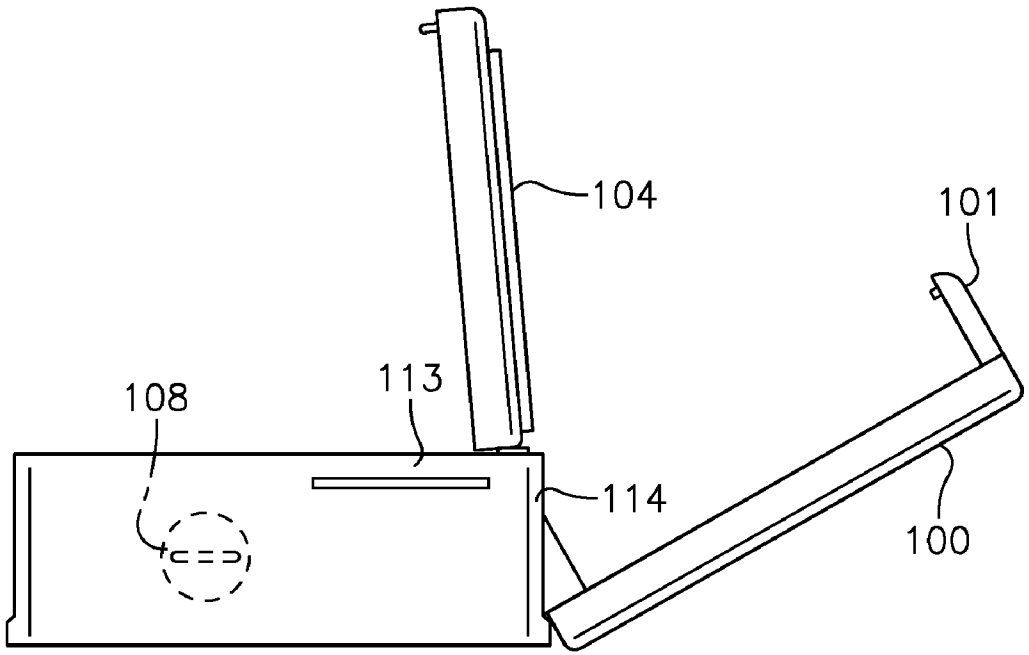
FIGS. 18A and 18B: Fully open front (FIG. 18A) and side (FIG. 18B) views of second embodiment of invention depicting: fully opened top cover (100); top cover latch (101); fully opened swing cover (104); swing cover hinge (113) and top cover hinge (114) and placement of the vibrating egg within the base of the device (108).
Figure 18A:
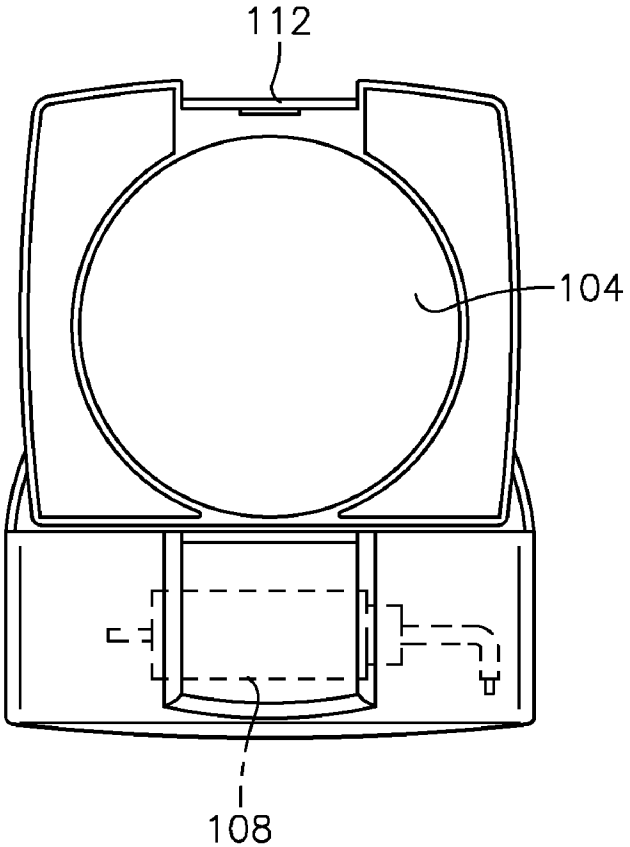

The swing cover is attached to the base by a hinge located upon the top center of the bases' rear panel. The top of the swing cover forms a receptacle for cosmetic cakes and as well as acting as a lid for the lower compartment which is concealed beneath it. The swing cover in this embodiment differs, from the preferred embodiment, in that the swing cover pivots upwards, in the same direction as the cover, to expose the contents of the lower compartment. FIGS. 18A and 18B.

As with the previous embodiment, the lower compartment houses a power supply, a control panel wired to the power supply, and a vibrating egg wired to the control panel. The retractable ribbon need not be utilized in this embodiment of the device. Rather, the cord (not shown in its entirety in the drawing) connecting the control panel to the egg may be freely stored beneath the egg.

A small latch is centrally mounted on the front of the swing cover. This small latch snaps into a recess on the front center of the base thereby securing the swing cover to the base. When in this position, the small latch acts as a recess for the large latch on cover. Thus, when the cover is pivoted from its open to its closed position, the latch snaps over the lower edge of the small latch and secures the cover to the swing cover and base simultaneously.

I claim:

1. A dual compartment, dual function, cosmetic compact and therapeutic device comprising:

an upper and a lower compartment, said upper compartment comprising a cover and a swing cover, said swing cover being hingedly attached to said cover at a hinged attachment point permitting said cover to pivot axially from an open to a closed position;

said cover being further comprised of interior and exterior surfaces; said lower compartment being further comprised of said swing cover and a base unit, said swing cover further comprising an upper and lower surface, a means for securely storing makeup in said upper surface, a means for mechanically connecting said lower surface of said swing cover to the base unit, said mechanical means further comprise a means to open and close said lower compartment and a means for latching said swing cover upper surface to said cover inner surface;

said base unit further comprising: a receptacle, a rechargeable power source attached to said receptacle, a base cover having an upper and lower surface with openings in said upper surface, a control panel attached to said lower surface of said base cover, said control panel including control buttons that are accessible through said openings in upper surface of said base cover, and a vibrating egg assembly housed in said base cover;

said rechargeable power source further comprising, a charging receptacle, rechargeable batteries, and a means for electrically connecting said batteries to said charging receptacle;

said control panel further comprising electrical input and output terminals, a means for electrically connecting said electrical input terminals to said rechargeable power source, a means for electrically connecting said output terminals to said vibrating egg assembly and a means for regulating electrical flow from said rechargeable power source, through said control panel, to said vibrating egg assembly;

said vibrating egg assembly further comprising a vibrating egg and a means for supplying electricity to said vibrating egg; said vibrating egg being further comprised of a motor assembly and a housing which encases said motor assembly; and, said motor assembly being further comprised of a variable speed electric motor, a means to supply electricity to said variable speed electric motor; a rotatable spindle shaft emanating from said variable speed electric motor, a weight being eccentrically mounted on said rotatable spindle shaft such that the vibrating egg vibrates when an electrical current is applied thereto.

2. A device as described in claim 1, wherein:

said interior cover surface is further comprised of a mirror, centrally adhesively attached to said interior cover surface;

said upper swing cover surface being further comprised of an applicator tray being hingedly attached to said upper swing cover surface at a radial location sufficiently distant from the hinged attachment point connecting the cover and the swing cover to allow the applicator tray to pivot about its hinged axis;

said means for securely storing makeup in said upper surface being further comprised of a cylindrical receptacle, said cylindrical receptacle is a centrally located cavity within said upper surface of the swing cover; said cavity being further comprised of a magnet, said magnet being adhesively or mechanically contained within said cavity;

said means for mechanically connecting said lower surface of said swing cover to the base unit is further comprised of a vertically protruding pivot post located on the lower surface of the swing cover and proximate to said hinged attachment point of said swing cover and said cover, wherein said pivot post mates with a post receptacle in the base unit achieving an interference fit;

said pivot post and said post receptacle being further positioned sufficiently distant from a vertical axis of the device to permit access to the base unit when said swing cover is rotated to its open position;

said the pivot post and said pivot post receptacle further being coaxially aligned such that the entirety of the exterior surfaces of the upper and lower compartments are concentrically aligned when the swing cover is in its fully closed position and no portion of the base cover is visible when viewed from the top of the closed device looking down;

said pivot post being further comprised of a terminal end, said terminal end being distally located from the lower surface of the swing cover, said terminal end further comprising an oversized circumferential tongue; said post receptacle being further comprised of a groove located near the bottom of the radial surface of the post receptacle which groove allows said oversized circumferential tongue, to achieve a snap fit with said groove;

said means for supplying electricity to said vibrating egg comprises a wire ribbon having two ends, and wire ribbon retractor;

said wire ribbon retractor further comprising a cover housing, a clutch release button, a release button spring, two contact brushes, a ribbon cable reel, a coil spring, a non-conducting contact retainer, two metal contacts, an insulating ring, and a base and a sub-assembly, said sub-assembly further comprising a central post and two electrical leads;

said clutch release button is further comprised of a hollow keyed post, approximately half of which is a flat surface and the remainder of which is radiused and having a top and bottom; said top of the post extends though a keyed hole in the top cover housing; said bottom of the hollow keyed post is further comprised of opposing blades; said opposing blades are mounted perpendicularly to the center axis of the hollow keyed post; said opposing blades are constructed such that the leading edges of said opposing blades are narrower than the following edges of the opposing blades, and the hollow keyed post retains a release button spring, said spring comprising a top surface and a bottom surface disposed within a hollow cylindrical center cavity;

said top surface of the spring bears against a bottom of said clutch release button and the bottom surface of the spring bears against the non-conducting contact retainer on the sub-assembly;

said ribbon cable reel is comprised of an upper and lower housing; said upper housing further comprising a split cylinder, a hollow center post at the center of said split cylinder, said hollow center post being the point of attachment for said two contact brushes comprising an upper brush and a lower brush, said brushes extend from an interior of the hollow center post to an exterior of the hollow center post; and one to four interior protrusions or stops protruding from an upper interior surface of the split cylinder towards the center of the split cylinder; a split in a cylinder wall provides an entry point for one end of the wire ribbon, said wire ribbon houses two wires and one of said two wires is electrically attached to the upper brush and the other of said two wires is electrically attached to said lower brush; and the other end of the wire ribbon is electrically connected to the vibrating egg assembly;

said lower housing comprises a receptacle for the coil spring, said coil spring having two ends; an inner end and an outer end; said ends of the coil spring are bent to form two hooks; an outer hook and an inner hook; the inner hook attaches to a post protruding axially from the base adjacent to the hole in the base assembly that accepts a contact sub-assembly; said outer hook attaches to a slot in the outer surface of the lower housing of the ribbon cable reel; said contact sub-assembly is comprised of said two electrical leads; an upper and a lower lead, one for each polarity + and –, and two metal contacts; an upper and lower contact; said upper and lower contacts are electrically isolated from each other by said insulation ring and are maintained in place by said non-conducting retainer at the terminus of the sub-assembly; the lower lead supplies electrical current to the upper contact and the upper lead supplies current to the lower contact; said upper and lower leads are electrically connected to the output terminals of the control panel; and, said contact sub-assembly is contained within the hollow center post on said ribbon cable reel such that the upper brush touches the upper contact and the lower brush touches the lower contact, forming an electrical connection between the terminals on the sub-assembly and the vibrating egg irrespective of the rotational orientation of the ribbon cable reel.

3. A device as described in claim 1, wherein:

said interior cover surface is further comprised of a mirror, centrally adhesively attached to said interior cover surface;

said interior cover surface being further comprised of a light ring, said light ring further comprising six to eight flat light emitting diodes ("LEDs") that encircle said mirror and are adhesively attached to the interior surface of the cover;

said upper surface of said swing cover being further comprised of a pressure switch, said pressure switch being further comprised of an electrical input and an electrical output, said electrical input being wired to the control panel and said electrical output being wired to the LEDs, such that power is supplied to the LEDs from the control panel when the cover is pivoted from its closed to its open position;

said upper surface of said swing cover being further comprised of an applicator tray, said applicator tray being hingedly attached to said upper swing cover surface at a radial location sufficiently distant from the hinged attachment point connecting the cover and the swing cover to allow the applicator tray to pivot about its hinged axis;

said means for securely storing makeup in said upper surface being further comprised of a cylindrical receptacle, said cylindrical receptacle is a centrally located cavity within the upper surface of the swing cover, said cavity being further comprised of a magnet, said magnet being adhesively attached or mechanically contained within said cavity;

said means for mechanically connecting said lower surface of said swing cover to the base unit is further comprised of a vertically protruding pivot post located on the lower surface of the swing cover and proximate to said hinged attachment point of said swing cover and said cover, wherein said pivot post mates, with a post receptacle in the base unit achieving an interference fit;

said pivot post and said post receptacle being further positioned sufficiently distant from a vertical axis of the device to permit access to the base unit when said swing cover is rotated to its open position;

said pivot post and said post receptacle further being coaxially aligned such that the entirety of the exterior surfaces of the upper and lower compartments are concentrically aligned when the swing cover is in its fully closed position and no portion of the base cover is visible when viewed from the top of the closed device looking down;

said pivot post being further comprised of a terminal end, said terminal end being distally located from the lower surface of the swing cover, said terminal end further comprising an oversized circumferential tongue; said post receptacle being further comprised of a groove located near the bottom of the radial surface of the post receptacle which groove allows said oversized circumferential tongue, to achieve a snap fit with said groove;

said means for supplying electricity to said vibrating egg comprises a wire ribbon having two ends, and wire ribbon retractor;

said wire ribbon retractor further comprising: a cover housing, a clutch release button, a release button spring, two contact brushes, a ribbon cable reel, a coil spring, a non-conducting contact retainer, two metal contacts, an insulating ring, and a base and a sub-assembly, said sub-assembly further comprising a central post and two electrical leads;

said clutch release button is further comprised of a hollow keyed post, approximately half of which is flat surface and the remainder of which is radiused and having a top and bottom; said top of the post extends though a keyed hole in the cover housing; said bottom of the hollow keyed post is further comprised of opposing blades; said opposing blades are mounted perpendicularly to a center axis of the hollow keyed post; said opposing blades are constructed such that leading edges of said opposing blades are narrower than the following edges of the opposing blades, and the hollow keyed post retains a release button spring, said spring comprising a top surface and bottom surface disposed within a hollow cylindrical center cavity;

said top surface of the spring bears against a bottom of said clutch release button and the bottom surface of the spring bears against the non-conducting contact retainer on the sub-assembly;

said ribbon cable reel is comprised of an upper and lower housing; said upper housing further comprising a split cylinder, a hollow center post at the center of said split cylinder, said hollow center post being the point of attachment for said two contact brushes comprising an upper brush and a lower brush, said brushes extend from an interior of the hollow center post to an exterior of the hollow center post; and one to four interior protrusions or stops, protruding from an upper interior surface of the split cylinder towards the center of the split cylinder; a split in a cylinder wall provides an entry point for one end of the wire ribbon, said wire ribbon houses two wires and one of said two wires is electrically attached to the upper brush and the other of said two wires is electrically attached to said lower brush; the other end of the wire ribbon is electrically connected to the vibrating egg assembly;

said lower housing comprises a receptacle for the coil spring, said coil spring having two ends; an inner end and an outer end; said ends of the coil spring are bent to form two hooks; an outer hook and an inner hook; the inner hook attaches to a post protruding axially from the base adjacent to the hole in the base that accepts a contact sub-assembly; said outer hook attaches to a slot in the outer surface of the lower housing of the ribbon cable reel;

said contact sub-assembly is comprised of said two electrical leads; an upper and a lower lead, one for each polarity + and –, and said two metal contacts; an upper and lower contact; said upper and lower contacts are electrically isolated from each other by said insulation ring and are maintained in place by said non-conducting retainer at the terminus of the sub-assembly; the lower lead supplies electrical current to the upper contact and the upper lead supplies electrical current to the lower contact, said upper and lower leads are electrically connected to the output terminals of the control panel; and said contact sub-assembly is contained within the hollow center post on said ribbon cable reel such that the upper brush touches the upper contact and the lower brush touches the lower contact forming an electrical connection between the terminals on the sub-assembly and the vibrating egg irrespective of the rotational orientation of the cable reel.

4. A dual compartment, dual function, cosmetic compact and therapeutic device comprising:

a cover, a swing cover and a base; sad cover further comprising a front and a rear and a top and a bottom, said cover front further comprising a large latch, and said rear of said cover further comprising a rectangular post, a length of said post being one-half the width of said base;

said swing cover further comprising front, back, left and right sides and a top and bottom surface, a distance between said top and bottom surfaces being the depth of said swing cover; said top surface of said swing cover further comprising a means for securely storing makeup in said swing cover top surface; said rectangular post further comprising a post top and a post bottom, said post top of said rectangular post being attached to the rear bottom of said cover, such that said rectangular post forms a 90 degree angle with the bottom of said cover;

said base further comprising an open top, closed bottom, four sides, said four sides being the right, left, front and rear sides; said right, left, front and rear sides having interior and exterior surfaces; said base being further comprised of a recess to accept a latch;

said rear outer surface of said base having a central recess extending from the top edge of the base towards the bottom of the base, said recess having a length and width equal to a length and a width of said rectangular post respectively; said post bottom being hingedly attached to the middle rear outer surface of the base, within said central recess, such that the cover may pivot about a hinged attachment to an open or closed position;

said swing cover being further comprised of a small latch centrally attached to said front side of said swing cover, said small latch acting as a recess to accept said large latch on the front of said cover; said swing cover being hingedly attached to the top rear surface of the base, such that said swing cover may pivot axially about said hinge to an open or closed position;

said base further comprising a receptacle, said receptacle houses a rechargeable power source, a control panel, and a vibrating egg assembly;

said rechargeable power source further comprising a charging receptacle, rechargeable batteries, and a means for electrically connecting said batteries to said charging receptacle;

said control panel further comprising electrical input and output terminals, a means for electrically connecting said electrical input terminals to said rechargeable power source, a means for electrically connecting said output terminals to said vibrating egg assembly and a means for regulating electrical flow from said rechargeable power source, through said control panel, to said vibrating egg assembly;

said vibrating egg assembly further comprising a vibrating egg and a means for supplying electricity to said vibrating egg; said vibrating egg being further comprised of a motor assembly and a housing which encases said motor assembly;

said motor assembly being further comprised of a variable speed electric motor, a means to supply electricity to said variable speed electric motor, a rotatable spindle shaft emanating from said variable speed electric motor, and a weight being eccentrically mounted on said rotatable spindle shaft such that the vibrating egg vibrates when electrical current is applied thereto;

said top swing cover surface being further comprised of an applicator tray, said applicator tray being hingedly attached to said top swing cover surface at a radial location sufficiently distant from the hinge connecting the cover and the swing cover to allow the applicator tray to pivot about its hinged axis; and said interior cover surface is further comprised of a mirror, centrally adhesively attached to said interior cover surface.

5. A removable and/or replaceable vibrating egg, wire ribbon and retractor assembly comprising:

a vibrating egg, said vibrating egg being electrically connected via a wire ribbon to a wire ribbon retractor assembly, said wire ribbon retractor assembly further comprising: a cover housing, a clutch release button, a release button spring, two contact brushes, a ribbon cable reel, a coil spring, a non-conducting contact retainer, two metal contacts, an insulating ring, and a base and a sub-assembly, said sub-assembly, further comprising a central post and two electrical leads;

said clutch release button is further comprised of a hollow keyed post, approximately half of which is flat surface and the remainder of which is radiused and having a top and bottom; said top of the post extends through a keyed hole in the cover housing; said bottom of the hollow keyed post is further comprised of opposing blades; said opposing blades are mounted perpendicularly to the center axis of the hollow keyed post; said opposing blades are constructed such that leading edges of said opposing blades are narrower than the following edges of the opposing blades and the hollow keyed post retains a release button spring, said spring comprising a top surface and a bottom surface disposed within a hollow cylinder center cavity;

said top surface of the spring bears against a bottom of said clutch release button and the bottom surface of the spring bears against the non-conducting contact retainer on the sub-assembly;

said ribbon cable reel is comprised of an upper and lower housing; said upper housing further comprising a split cylinder, a hollow center post at the center of said split cylinder, said hollow center post being the point of attachment for said two contact brushes comprising an upper brush and a lower brush, said brushes extend from an interior of the hollow center post to an exterior of the hollow center post, and one to four interior protrusions or stops, protruding from an upper interior surface of the split cylinder towards the center of the split cylinder, a split in a cylinder wall of the split cylinder provides an entry point for one end of the wire ribbon, said wire ribbon houses two wires and one of said two wires is electrically attached to the upper brush and the other of said two wires is electrically attached to said lower brush; the other end of the wire ribbon is electrically connected to the vibrating egg assembly;

said lower housing comprises a receptacle for the coil spring, said coil spring having two ends; an inner end and an outer end; said ends of the coil spring are bent to form two hooks; an outer hook and an inner hook; said inner hook attaches to a post protruding axially from the base adjacent to a hole in the base assembly that accepts a contact sub-assembly; said outer hook attaches to slot in the outer surface of the lower housing of the ribbon cable reel;

said contact sub-assembly is comprised of said two electrical leads; an upper and a lower lead, one for each polarity + and −, and said two metal contact; an upper contact and lower contact; said upper and lower contacts are electrically isolated from each other by said insulation ring and are maintained in place by said non-conducting retainer at the terminus of the sub-assembly; the lower lead supplies electrical current to the upper contact and the upper lead supplies electrical current to the lower contact; said upper and lower leads are electrically connected to the output terminals of the control panel; and said contact sub-assembly is contained within the hollow center post on said ribbon cable reel such that the upper brush touches the upper contact and the lower brush touches the lower contact forming an electrical connection between the terminals on the sub-assembly and the vibrating egg irrespective of the rotational orientation of the cable reel.

* * * * *